US006245423B1

(12) United States Patent
Ikeda et al.

(10) Patent No.: US 6,245,423 B1
(45) Date of Patent: Jun. 12, 2001

(54) THICK ACRYLIC FIBER TOWS FOR CARBON FIBER PRODUCTION AND METHODS OF PRODUCING AND USING THE SAME

(75) Inventors: Katsuhiko Ikeda; Toshihiro Makishima; Nobuyuki Fukuen, all of Otake (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 0 days.

(21) Appl. No.: 09/594,176

(22) Filed: Jun. 15, 2000

(30) Foreign Application Priority Data

Jun. 15, 1999 (JP) ..... 11-168587

(51) Int. Cl.[7] ..... D01F 6/00; D01F 6/18
(52) U.S. Cl. ..... 428/364; 428/394; 264/206
(58) Field of Search ..... 428/364, 394; 264/206

(56) References Cited

U.S. PATENT DOCUMENTS 5,348,802 * 9/1994 Matsuhisa et al. ..... 428/364
5,401,576 * 3/1995 Yoon et al. ..... 428/364

FOREIGN PATENT DOCUMENTS 5-140815 6/1993 (JP) .
5-195313 8/1993 (JP) .
10-215924 9/1998 (JP) .
11-12874 1/1999 (JP) .

* cited by examiner

*Primary Examiner*—N. Edwards
(74) *Attorney, Agent, or Firm*—Oblon, Spivak, McClelland, Maier & Neustadt, P.C.

(57) ABSTRACT

An acrylic fiber tow having a total size of at least 22,000 dtex and a weight variation ratio in the longitudinal direction of not greater than 3.5%, which is useful as a precursor for carbon fiber production.

14 Claims, 2 Drawing Sheets

EXAMPLE 1:X=30mm, h=15mm

EXAMPLE 2:X=40mm, h=20mm

EXAMPLE 3:X=40mm, h=15mm

COMPARATIVE EXAMPLE 1:X=40mm, h=30mm

COMPARATIVE EXAMPLE 2:X=40mm, h=10mm

THICK ACRYLIC FIBER TOWS FOR CARBON FIBER PRODUCTION AND METHODS OF PRODUCING AND USING THE SAME

BACKGROUND OF THE INVENTION

1. Field of the Invention

The present invention relates to thick carbon fiber precursor acrylic tows containing at least 20,000 filaments, with high quality and high productivity, as well as methods of producing and using the same.

2. Description of the Background

Demand for carbon fibers has increased in recent years, since they are widely used in premium applications, such as in airplane and sporting goods manufacture, and in general industrial applications typified by civil engineering. To satisfy the increasing demand of fibers for such applications, a drastic reduction in the cost of production of fibers, as well as an increase in fiber production capacity has been required. As a means for increasing the productivity of acrylic fiber tows as the precursor of carbon fibers, it has been found not to be effective to increase the total denier of the fibers by increasing the number of single fibers constituting the tows and to improve productivity per setup.

According to conventional methods of production, a spinning dope is guided into a coagulation bath to prepare coagulated tows. To guide and draw the tows, a plurality of rollers is used to transfer the tows before they are dried and compacted. However, when the total size of the tows is increased, the existing setups that are based on 12,000 filaments suffer from the disadvantage that the gap between the tows of adjacent weights becomes small and mutual interference and blending of the tows occur. As a result, damage of the single fiber, breakage, fluff and bonding, for example, occur and the process approval factor deteriorates. At the same time, a non-uniform size in a subsequent drawing processes invites non-uniformity of the size and also eventually, a deterioration of the properties of the resulting carbon fiber.

In order to prevent such a problem, the width of each roller must be widened in order to enlarge the gap between the tows of the adjacent weights. In this case, large modification of the setups, inclusive of a driving unit, must be made. If the roller is widened excessively, the guide operation of the tow and counter-measures to cope with problems become more difficult. These problems raise serious problems from the standpoint of safety.

Japanese Patent Laid-Open No. 5-195306 describes a method of controlling the tow width by using curved guides during the processing inside a bath. While this method allows for control of the tow width between the guides inside the bath, however, the problem of mutual interference and blending of the tows remains problematic on the rollers where problems are more likely to occur. Moreover, the weight variation ratio in the longitudinal direction of the tow made by prior art method is very large. As the result, the tensile strength in the longitudinal direction of the tow is not uniform. At the same time, the process approval factor deteriorates and non-uniform oiling occurs. The properties of the resulting carbon fiber deteriorate also.

Thus, a need continues to exist for a method of producing acrylic fiber tows for carbon fiber production which overcomes the above disadvantages.

SUMMARY OF THE INVENTION

Accordingly, one object of the present invention is to provide a thick acrylic fiber tow for carbon fiber production, wherein mutual interference and blending of the adjacent acrylic fiber tows is prevented during the production of the acrylic fiber tows, and to methods of producing and using the tow.

Another object of the present invention is to provide thick acrylic fiber tows for carbon fiber production having a total size of at least 22,000 dtex.

Still a further object of the present invention is to provide a method of producing the above described acrylic fiber tow.

Briefly, these objects and other objects of the present invention as hereinafter will become more readily apparent can be attained by a thick acrylic fiber tow, as a precursor for the production of carbon fibers, having a total size of at least 22,000 dtex and a weight variation ratio in a longitudinal direction of not greater than 3.5%.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
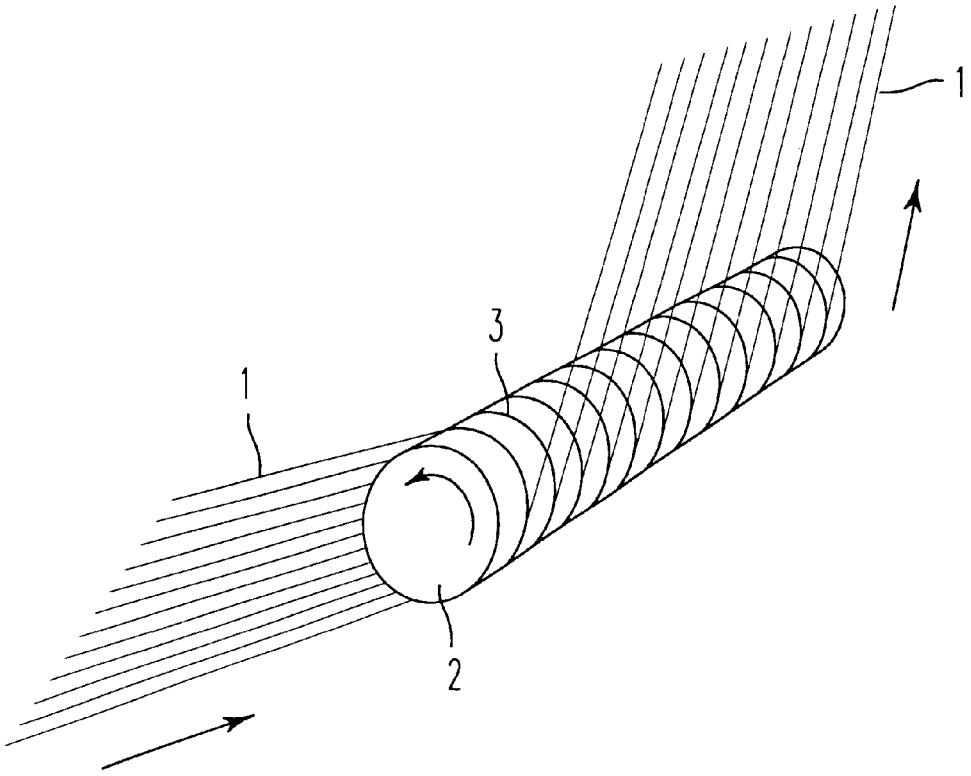
FIG. 1 is a schematic diagram of an example of a grooved roller of the present invention.

In accordance with the present invention a high-quality and economical carbon fiber with a high process approval factor is provided by preventing the mutual interference and blending of the adjacent tows of thick acrylic fiber tows as precursors for the production of carbon fibers, while total size is increased.

The present invention provides, in part, a method of producing acrylic fiber tows for production of carbon fibers by spinning an acrylonitrile polymer and then drying and compacting swollen tows while in the swollen state, wherein the swollen tows have a final total size of at least 22,000 dtex and are guided by grooved rollers in order to control the tow width.

The present invention also provides acrylic fiber tows for carbon fiber production by controlling the tow width by grooved rollers disposed in front of several drawing machines and forming uniform tows so that the weight variation ratio of the size of the precursor acrylic fiber tows obtained from the drawing machines, in the longitudinal direction, is not greater than 3.5%, preferably not more than 3%. The present invention relates also to a method of producing such tows.

In more detail, the groove shape of the grooved rollers of the invention is such that the width thereof becomes progressively smaller from the groove top to the groove bottom, the sectional shape of the groove describing a smooth curved surface, and the groove shape satisfying the following relational formulas (1) and (2). When these formulas are maintained, the tow width can be controlled extremely effectively and desirably.

$$1.3 \leqq X/h \leqq 3.0 \quad (1)$$

$$350\ mm^2 \leqq S \leqq 700\ mm^2 \quad (2)$$

In the formulas, X is the width of the groove top, h is the groove depth and S is the sectional area of the groove.

The acrylonitrile polymers used in the present invention are not limited, in particular, as long as they are used in the preparation of acrylonitrile fibers, which are used as precursors for carbon fiber production. Homopolymers or copolymers of acrylonitrile, or their mixed polymers, may be used as the acrylonitrile polymers. Examples of monomers that can be copolymerized with acrylonitrile include (meth) acrylates, such as methyl (meth)acrylate, ethyl (meth) acrylate, propyl (meth)acrylate, butyl (meth)acrylate and hexyl (meth)acrylate; halogenated vinyl compounds such as vinylidene chloride; maleic acid imide, phenyl maleimide, (meth)acrylamide, styrene, α-methylstyrene, vinyl acetate; polymerizable unsaturated monomers containing a sulfone group such as sodium styrenesulfonate, sodium acrylsulfonate and sodium β-styrenesulfonate; and polymerizable unsaturated monomers containing a pyridine group such as 2-vinylpyridine and 2-methyl-5-vinylpyridine. However, the invention is not limited to these monomers.

A suitable monomer mixture can be polymerized, for example, by redox polymerization in an aqueous solution, suspension polymerization in a heterogeneous system or emulsion polymerization using a dispersant. However, the invention is not limited to these methods.

In the method of production according to the present invention, these acrylonitrile type, i.e., acrylonitrile-based, polymers are first dissolved in a solvent such as dimethylacetamide, dimethyl sulfoxide, dimethylformamide, nitric acid or an aqueous sodium thiocyanate solution to prepare a spinning dope.

Next, the spinning dope is discharged into a coagulation bath through a spinneret having at least 20,000 holes, preferably at least 24,000 holes (wet spinning), to obtain the coagulated tows. Alternatively, the spinning dope is discharged into the air and is then guided to the coagulation bath (dry-wet spinning). An aqueous solution containing a solvent that is generally used for the spinning dope is used for the coagulation bath.

The coagulated tows obtained in this state contain water inside the fibers and remain swollen until they are dried and compacted in a subsequent process step. In ordinary production methods, the coagulated tows are taken-up by a godet roller, are then passed through necessary process steps such as washing, drawing, application of an oiling agent, and are thereafter dried and compacted to give a precursor fiber for a carbon fiber.

The present invention uses grooved rollers as the rollers that guide and pass the tows while swollen after the tows are spun and before they are dried and compacted as coagulated tows. That is, the present invention uses grooved rollers through which the tows, while swollen, are passed, for producing thick fiber tows of the type such that the total size of the precursor fiber obtained finally by drying and compacting the tows is at least 22,000 dtex. The rollers include those rollers which guide the tows and define the feeding direction, those which are used for drawing, and so forth. In this instance, all the rollers may be the grooved rollers, or the grooved rollers may be used for only those portions at which the tow width is to be particularly controlled. The godet roller for taking-up the coagulated tows from the coagulation bath is preferably used as the grooved roller. When a swollen tow is drawn using non-grooved rollers in a coagulation bath, and then is washed with water and simultaneously drawn, a swollen tow not having been drawn with control of tow width, is damaged by guides at the entrance of the washing bath. Further, the draw ratio in the central part and on both sides of the swollen tow are different. As a result, the weight variation ratio in the longitudinal direction of the final acrylic fiber tow is 6–7% and is not uniform.

The total size of the final acrylic fiber tows of the present invention is at least 22,000 dtex, but preferably ranges from at least 22,000 dtex to not greater than 99,000 dtex. Though the present invention may be applied to tows having a total size of less than 22,000 dtex, the interference between the adjacent tows and blending of the tows is not as serious a problem in this instance. Therefore, the need for, and advantages of the present invention become increasingly apparent at 22,000 dtex and above. The total size exceeding 99,000 dtex results in the problems of tow handling and an increase in tow volume. Because the drying load increases in the existing setups, the spinning rate cannot be elevated.

FIG. 1 schematically shows an example of a grooved roller of the present invention. A plurality of swollen tows 1 is taken-up by roller 2, while the tow width is controlled by grooves 3 formed on the cylindrical surface of the roller 2, and are then transferred from the roller. The grooved roller is preferably equipped with a plurality of grooves on its cylindrical surface as shown in the drawing, because in this case a plurality of tows can be processed simultaneously. However, an independent roller may be used for each tow.

The sectional shape of each groove on the roller is such that the width of the tow, when the tow moves away from, and, leaves, the roller, is smaller than when it is introduced into the roller and first comes into contact with the roller. In other words, the groove width becomes progressively smaller from the groove top towards the groove bottom. In this case, the sectional shape of the groove preferably describes a smooth curved surface.

Figure 2:
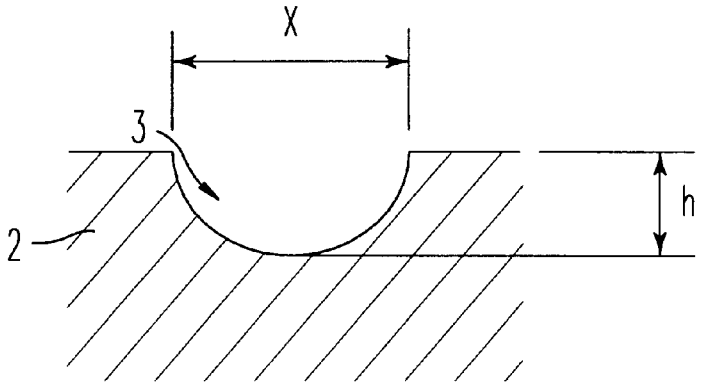
FIG. 2 is a sectional view of an embodiment of a groove in the surface of a grooved roller of the present invention.
Figure 3A:
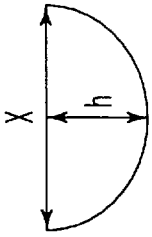
FIG. 3 shows sectional views of several groove configuration embodiments of grooved rollers of the present invention and comparative rollers.
Figure 3B:
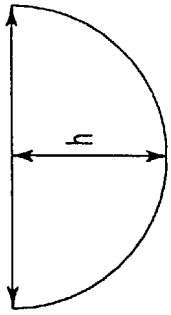
Figure 3C:
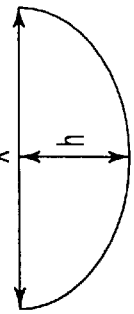
Figure 3D:
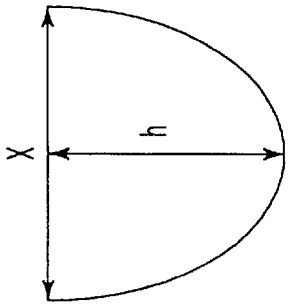
Figure 3E:
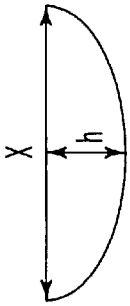

An example of such a groove shape is a substantially semi-elliptic (inclusive of semi-circular shape) as shown in FIG. 2.

The sectional shape of the grooved roller used in the present invention preferably satisfies the following relationships (1) and (2) where X is the width of the groove top, h is the groove depth and S is the groove sectional area (see FIG. 2):

$$1.3 \leqq X/h \leqq 3.0 \quad (1)$$

$$350\ mm^2 \leqq S \leqq 700\ mm^2 \quad (2)$$

The values X, h and S can be selected appropriately within the range satisfying these conditions without imparting damage to the tow, upon consideration of the volume of the tow and the number of filaments constituting the tow. The gap between the adjacent weights, too, can be determined appropriately.

The material of the grooved roller is not limited, in particular, but a stainless steel material which is very corrosion resistant is preferred. The grooved roller is preferably plated lest any damage is imparted to the fiber tow because of contact resistance between the grooved roller and the swollen tows.

As described above, the present invention guides the thick tows while swollen and brings the tows into contact with the grooved rollers, and can thus control tow width and can prevent interference between the adjacent weights and blending. Therefore, the present invention can economically produce the thick acrylic fiber tows having high quality and a high process approval factor for the preparation of carbon fibers.

The thick carbon fiber precursor acrylic tows obtained by the present invention can be converted to high quality carbon fiber through process steps including flame resistance-imparting treatment, carbonization treatment, for example.

Having now generally described this invention, a further understanding can be obtained by reference to certain specific Examples which are provided herein for purposes of illustration only and are not intended to be limiting unless otherwise specified.

EXAMPLES

Example 1

Acrylonitrile, methyl acrylate and methacrylic acid were copolymerized by aqueous suspension polymerization using ammonium persulfate, ammonium hydrogensulfite and iron sulfate as the catalyst system to give an acrylonitrile copolymer having a composition comprising an acrylonitrile unit/methyl acrylate unit/methacrylic acid unit ratio of 95/411 (weight ratio). This copolymer was dissolved in dimethylacetamide to prepare a spinning dope having a concentration of 21 wt. %.

This spinning dope was passed through a spinneret having 24,000 holes, each hole having a diameter of 60 mm, and was discharged into a coagulation bath consisting of an aqueous dimethylacetamide solution having a concentration of 65 wt. % at 35° C. to give coagulated tows. Next, the tows were washed with water and were simultaneously drawn 2 times, and were further drawn 2.5 times in boiling water. Thereafter, the tows were subjected to oiling, drying, and secondary drawing. Thick acrylic fiber tows having a single fiber size of 1.0 Denier (1.1 dtex) were taken-up.

In this example grooved rollers, having a semi-elliptic groove shape (X=30 mm, h=15 mm, S=350 $mm^2$; see FIG. 3) were employed as the free roller disposed on the coagulation bath and as the two, first codet rollers for taking-up the coagulated tows and as the two, second codet rollers. Groove-free rollers were used for the rest of the rollers in subsequent processing of the tows. The coagulated tows while swollen were brought into contact with the respective rollers. As a result, the gap between the adjacent weights could be reduced to 5 mm, and spinning could be conducted stably without problems such as blending, interference, and so forth. The forms of the tows traveling through the process steps were also free from problems such as tow cracking and tow biasing. The results of evaluation of the production process and the results of evaluation of the resulting precursor fibers are tabulated in the Table below.

In this table, bonding between the single yams was judged by cutting the precursor fiber taken-up into about 5 mm lengths, dispersing the cut fibers in 100 ml of water, stirring the cut fibers at 100 rpm, filtering the fibers through black filter paper and counting the number of bonded single yarns. The weight variation ratio (CV-value) in the longitudinal direction of fiber tows for Examples 1–3 and the Comparative Examples was measured by the following method.

1) The acrylic fiber tow was cut into thirty pieces each of a length of about 1000 mm.
2) The weight per unit length of each piece was measured correctly.
3) The weight variation ratio (CV-value) was calculated from the weights per unit length.

Examples 2 and 3 & Comparative Examples 1 and 2

The experiments were conducted in the same way as described in Example 1 with the exception that the shapes of the grooved rollers were set as described in the embodiments below.

The groove shapes are shown in FIG. 3.

Example 2: X=40 mm, h=20 mm, S=630 $m^2$;

Example 3: X=40 mm, h=15 mm, S=471 $mm^2$;

Comparative Example 1: X=40 mm, h=30 mm, S=940 $mm^2$;

Comparative Example 2: X=40 mm, h=10 mm, S=314 $mm^2$.

Comparative Example 3

The experiment was conducted in the same way as in Example I with the exception that a flat roller was used in place of each grooved roller.

The results of Examples 1–3 and Comparative Examples 1–3 are shown in the Table below.

| | Bonding of single fibers (numbers) | Number of times of blending (times/day) | Number of times of breakage (times/day) | Tow form | Weight Variation ratio in longitudinal direction |
|---|---|---|---|---|---|
| Example 1 | nil | nil | nil | fair | 2.81% |
| Example 2 | nil | nil | nil | fair | 2.77% |
| Example 3 | nil | nil | nil | fair | 2.55% |
| Comp. Ex 1 | nil | nil | nil | tow cracks formed | 4.62% |
| Comp Ex. 2 | 20 pcs | 12 | 4 | blending and interference of fiber tows occurred | 9.66% |
| Comp. Ex. 3 | spinning was impossible | spinning was impossible | spinning was impossible | — | — |

When the thick acrylic fiber tows are produced by increasing the total size of the tows while preventing interference and blending of adjacent tows, the present invention can provide a method of economically producing quality carbon fibers having an excellent process approval factor and excellent properties and which are free from fluff. The present acrylic fiber tow exhibits a uniform weight variation ratio in the longitudinal direction, an excellent process approval factor, a uniform tensile strength in the longitudinal direction and is free from non-uniform oiling.

The disclosure of Japanese priority Application No. 11-168587 filed Jun. 15, 1999 is hereby incorporated by reference into the present application.

Having described the present invention, it will now be apparent to one of ordinary skill in the art that many changes and modifications may be made without departing from the spirit and scope of the present invention.

What is claimed as new and is intended to be secured by Letters Patent is:

1. An acrylic fiber tow having a total size of at least 22,000 dtex and a weight variation ratio in the longitudinal direction of not greater than 3.5%, which is useful as a precursor for carbon fiber production.

2. The acrylic fiber tow of claim 1, wherein the number of single fibers constituting the two is at least 20,000.

3. The acrylic fiber tow of claim 1, having a total size of up to 99,000 dtex.

4. The acrylic fiber tow of claim 1, wherein the weight variation ratio in the longitudinal direction is not greater than 3%.

5. The acrylic fiber tow of claim 1, wherein the fibers of the acrylic tow are prepared from acrylonitrile homopolymer or copolymers.

6. The acrylic fiber tow of claim 5, wherein the comonomer copolymerized with the acrylonitrile to form an acrylonitrile copolymer is a member selected from the group consisting of a (meth)acrylate ester, a halogenated vinyl compound, maleic acid imide, phenyl maleimide, (meth) acrylamide, styrene, α-methylstyrene, vinyl acetate, polymerizable unsaturated monomers containing a sulfone group and polymerizable unsaturated monomers containing a pyridine group.

7. The acrylic fiber tow of claim 1, wherein the acrylic fiber tow has a size ranging from 22,000 dtex to 99,000 dtex.

8. A method of producing an acrylic tow, which comprises:

a) spinning a dope of an acrylonitrile-based polymer into a coagulation bath, wherein the coagulated fiber tows are guided by grooved rollers in order to control the width of the fiber tows; and then b) drying and compacting the formed tows while swollen;

wherein the swollen tows have a final total size of at least 22,000 dtex.

9. The method of claim 8, wherein the spinning dope is discharge into the coagulation bath through a spinneret having at least 20,000 holes.

10. The method of claim 9, wherein the spinneret has at least 24,000 holes.

11. The method of claim 8, wherein the spinning dope is prepared by dissolving the acrylonitrile based polymer in a solvent of dimethylacetamide, dimethyl sulfoxide, dimethylformamide, nitric acid or an aqueous sodium thiocyanate solution.

12. The method of claim 8, wherein the groove shape of said grooved rollers changes in such a fashion that the width thereof decreases progressively from groove top to groove bottom, and the sectional shape of the groove is a curved surface which satisfies the following relational formulas (1) and (2):

$$1.3 \leqq X/h \leqq 3.0 \quad (1)$$

$$350\ \text{mm}^2 \leqq X \leqq 700\ \text{mm}^2 \quad (2)$$

wherein X is the width of the groove top, h is the groove depth, and S is the groove sectional area.

13. A method of preparing carbon fibers, which comprises:

converting the acrylic fiber tow of claim 1 into carbon fibers.

14. The method of claim 13, wherein the acrylic fiber tow is converted into carbon fibers by carbonization.

* * * * *